US008327778B2

(12) United States Patent
DelloRusso, Jr.

(10) Patent No.: US 8,327,778 B2
(45) Date of Patent: Dec. 11, 2012

(54) LIGHT WEIGHT PORTABLE FIRE RESISTANT CONTAINMENT SYSTEM

(76) Inventor: Anthony J. DelloRusso, Jr., Bernardsville, NJ (US)

( * ) Notice: Subject to any disclaimer, the term of this patent is extended or adjusted under 35 U.S.C. 154(b) by 174 days.

(21) Appl. No.: 12/589,870

(22) Filed: Oct. 28, 2009

(65) Prior Publication Data

US 2011/0094423 A1 Apr. 28, 2011

(51) Int. Cl.
*E04B 2/02* (2006.01)
*E06B 5/12* (2006.01)

(52) U.S. Cl. ..... 109/80; 109/26; 109/76; 109/84

(58) Field of Classification Search ..... 109/26–28, 109/58, 59 R, 64, 66, 74, 76, 77, 80, 83, 84
See application file for complete search history.

(56) References Cited

U.S. PATENT DOCUMENTS

| | | | | | |
|---|---|---|---|---|---|
| 1,749,222 | A | * | 3/1930 | Merriam | 109/74 |
| 1,781,488 | A | * | 11/1930 | Abbott | 109/74 |
| 1,870,746 | A | * | 8/1932 | Pyle | 109/59 R |
| 2,030,219 | A | * | 2/1936 | Meilink | 109/59 R |
| 2,613,623 | A | | 10/1952 | Behrens | 109/59 R |
| 3,408,966 | A | | 11/1968 | Gartner | 109/74 |
| 3,709,169 | A | * | 1/1973 | Gauger et al. | 109/29 |
| 3,735,714 | A | * | 5/1973 | Shoop | 109/59 R |
| 3,762,787 | A | * | 10/1973 | Grubb | 109/80 |
| 3,855,741 | A | | 12/1974 | Semon | 52/19 |
| 3,855,949 | A | * | 12/1974 | Foster et al. | 109/23 |
| 4,048,926 | A | | 9/1977 | Brush, Jr. et al. | 109/65 |
| 4,263,365 | A | | 4/1981 | Burgess et al. | 428/312.4 |
| 4,272,137 | A | | 6/1981 | Rothhaas | 312/409 |
| 4,303,286 | A | * | 12/1981 | McClellan | 109/58 |
| 4,307,543 | A | | 12/1981 | Schulthess | 49/501 |
| 4,574,454 | A | * | 3/1986 | Dyson | 109/65 |
| 4,593,627 | A | * | 6/1986 | Lankard et al. | 109/83 |
| 4,721,227 | A | | 1/1988 | Hughes et al. | 220/560.01 |
| 4,735,155 | A | | 4/1988 | Johnson | 109/24 |
| 4,741,276 | A | | 5/1988 | Pollock | 109/25 |
| 4,893,397 | A | * | 1/1990 | Hughes | 109/59 R |
| 5,069,358 | A | * | 12/1991 | Avery, Jr. | 109/84 |
| 5,152,231 | A | | 10/1992 | Preston et al. | 109/65 |
| 5,970,889 | A | | 10/1999 | Shaffer et al. | 109/65 |
| 6,170,481 | B1 | | 1/2001 | Lyons et al. | 126/512 |

(Continued)

FOREIGN PATENT DOCUMENTS

GB 2168402 A * 6/1986

(Continued)

*Primary Examiner* — Christopher Boswell
(74) *Attorney, Agent, or Firm* — Ernest D. Buff; Ernest D. Buff Associates LLC; Dave Narasimhan

(57) ABSTRACT

A lightweight portable fire resistant containment system has an outer shell and an inner shell that fits inside the outer shell, forming an insulating air gap. A lid closes the outer shell, defining a closed storage space. The outer shell, inner shell and lid are fabricated from high temperature resisting ceramic fibers and are bonded together with an inorganic or charred bond to form a light weight integral component. A stainless steel sheet wrap prevents ingress of flame and hot gas into the bonded ceramic fibers of the outer shell and lid. The inner shell outer surface has a metallic infrared reflecting wrap limiting radiation received from the inner surface of the outer shell. The inner surface of the inner shell has an encased ceramic porous body infiltrated with solidified phase change material, absorbing latent heat of fusion from the interior surface of inner shell and limiting temperature exposure of valuable stored documents and photographs.

10 Claims, 3 Drawing Sheets

U.S. PATENT DOCUMENTS

| | | | | |
|---|---|---|---|---|
| 6,736,473 | B2 * | 5/2004 | Cleveland et al. | 109/80 |
| 6,752,092 | B2 | 6/2004 | Beattie et al. | 109/75 |
| 2007/0053162 | A1 * | 3/2007 | Keenan et al. | 361/700 |
| 2009/0205542 | A1 * | 8/2009 | Chang | 109/23 |

FOREIGN PATENT DOCUMENTS

| | | |
|---|---|---|
| JP | 8270323 | 10/1996 |

* cited by examiner

LIGHT WEIGHT PORTABLE FIRE RESISTANT CONTAINMENT SYSTEM

BACKGROUND OF THE INVENTION

1. Field of the Invention

The present invention relates to fire containment systems; and, more particularly, to a lightweight portable fire resistant containment system for preserving memory objects such as photographs, documents and the like in case of a fire event.

2. Description of the Prior Art

Many patents address issues related to fireproof containment boxes. The patents and patent publications that disclose fireproof containment are discussed below.

U.S. Pat. No. 2,613,623 to Preston et al. discloses an insulated filing cabinet construction. The file cabinet is made from steel casing that forms a plurality of rectangular boxes. Each wall of the casing contains insulating material. Inherently, the insulated filing cabinet disclosed by the '623 patent is a heavy weight device, as shown by the requirement of casting wheels at the bottom. The insulating material is not indicated to withstand high temperature exposure.

U.S. Pat. No. 3,408,966 to Gartner discloses a fireproof container. This fireproof container has an inner container surrounded by an outer container. A heat protection liner made from fibrous material having high temperature insulation properties is provided between the outer frame and the inner container. A jamb having an irregular undersurface portion with fibrous material is positioned in mating relationship with the jamb, providing a torturous heat flow closure path. The fireproof container has an outer shell of cold rolled steel, an inner container of molded plastic, and two layers of fibrous high temperature resistant fibers, followed by heat insulative fibers. Such a fireproof container, as disclosed by the '966 patent, is a heavy object. It is not made entirely from lightweight high temperature resisting fibers that have a high level of porosity, providing insulation properties.

U.S. Pat. No. 3,855,741 to Semon discloses a closure for a fire resistant structure. This container is protective against a high temperature of restricted duration. The cast container with plaster of Paris is destroyed by high temperature exposure, while the magnesium sulfate hydrate degrades in steps, leaving behind a fire resistant composition. This fire resistant structure has a facing of low melting glass cloth with epoxy bond. Such a fire resistant structure is not made from fibrous material.

U.S. Pat. No. 4,048,926 to Brush, Jr. et al. discloses a safe. The safe has a non-metallic outer shell, an inner shell with molded insulation material therebetween. The molded material is indicated to have a substantial amount of chemically bonded water similar to foamed Portland cement. The safe is not made from ceramic fibrous material.

U.S. Pat. No. 4,263,365 to Burgess et al. discloses a fire-resistant safe and panel. This safe has a heat absorbing body made from a mixture of water, Portland cement, cellulose fibers, and a foaming agent, with or without other ingredients such as water glass and sodium sulfate. Polypropylene fibers may be used in place of part or all of the cellulose fibers. The safe has a plastic outer shell and an inner shell made from plastic or steel. The space between the inner and outer shell is filled with foamed cement composition that has recycled cellulose fibers. Sodium silicate may be added to the cement mixture. The composition resists fire by breaking down water of hydration as it crumbles by heat. Cement is heavy and consequently the safe is not portable. The safe does not use fire resistant ceramic fibers.

U.S. Pat. No. 4,272,137 to Rothhaas discloses a fire resistant cabinet with a protective void in a gypsum filling. A heat resistant cabinet has a gypsum filling provided in the interspace between the outer casing and the inner surface. This filing cabinet has a metal sheet outer surface with a gypsum filling. The gypsum filling has a hollow space provided for subsequent use as an air gap space or filling by plastic foam. Gypsum decomposes when exposed to heat by loss of water of hydration, essentially crumbling the gypsum layer. The gypsum sheet is indicated to crack especially around the free space area. This is a heavy cabinet and not a portable device.

U.S. Pat. No. 4,307,543 to Schulthess discloses a door. This door is primarily intended for applications that require a fire resistant door. The door has a metal frame with a foamable strip present in the rebate of the door. The strip foams when heated by a fire, sealing the door. The '543 disclosure does not provide a flameproof portable box for containment of photographs and documents.

U.S. Pat. No. 4,721,227 to Hughes et al. discloses a fire-resistant container. This fire-resistant container is said to protect magnetic media such as floppy discs, and comprises a base and a cover. The fire resistant metal container is filled with compressed insulation designed to expand when the outer layer is expanded by application of heat. Inside the insulation is a container filled with molten and solidified wax that will melt at 50° C., preventing the contents of the fire-resisting container beyond 50° C. An aluminum foil cover is provided on either side of the wax container to equalize hot spots. The fire-resistant container disclosed by the '227 patent is not a lightweight fire resistant box; it is not made from fireproof ceramic fibers. Instead, the insulation of the '227 container is composed of silica powder with some silica or alumina fibers for reinforcement.

U.S. Pat. No. 4,735,155 to Johnson discloses a fire resistant enclosure. The casing and door for this enclosure is made from resinous material such as epoxy polyimide or polyvinyl chloride that chars readily. The resin may be reinforced with mineral fiber in the form of glass wool, and protected with heat reflecting aluminum sheet. The enclosure is a multi-component heavy device. It does not rely on the fire resistance of a ceramic fiber and does not rely on the porosity of the ceramic fiber matrix to resist heat flow.

U.S. Pat. No. 4,741,276 to Pollock discloses a fire resistant cabinet. This is a heavy fire resistant cabinet made from an inner casing of steel and an outer container of steel. The space between these casings is filled with hydrated sodium metasilicate, a phase change material. The space between the inner and outer casing has a plurality of metal foils parallel to the outer casing in order to reflect heat. The fire resistant cabinet disclosed by the '276 patent is not a lightweight fire resistant containment system, and it does not use fire resistant ceramic fibers.

U.S. Pat. No. 5,152,231 to Preston et al. discloses a fire-resistant safe. This fire resistant safe is made from resin sheets that form the interior enclosure and exterior enclosure with insulation provided there between. As the resin catches fire, it produces vertical channels for the passage of air, promoting vigorous combustion. Vertical air flow is prevented (i) by use of corner jambs that are made thin, thereby producing a narrow air flow, restricted pathway, or (ii) by use of compressively loaded resin sheets. The fire resistant safe disclosed by the '231 patent does not use ceramic fibers.

U.S. Pat. No. 5,970,889 to Shaffer et al. discloses a steel shell safe with a snap-in resin liner. This safe has an outer steel shell with a resin liner inserted there within. An insulation material is provided between the steel shell and the resin liner.

The steel shell safe with snap in liner is heavy and is not a portable light weight product. It does not use fire resistant ceramic fibers.

U.S. Pat. No. 6,170,481 to Lyons et al. discloses an open-ended molded fireplace box and method. This is a molded ceramic fiber insert that is directly cast into a heavy steel component which is designed to be inserted into a fireplace. This fireplace insert is not a portable lightweight box that uses porously bonded fire resistant ceramic fibers; it is not designed to protect photographs and documents.

U.S. Pat. No. 6,752,092 to Beattie et al. discloses a fire and water-resistant container. The bottom and top shells are made from metal or resin and the space there between is filled with a fire proof insulator, which is hydrated Portland cement. The container is therefore heavy due to the cement insulation. The hydrated Portland cement will disintegrate due to loss of water of hydration when exposed to fire. The shell, hinge and gasket may also be destroyed by fire as indicated in the '092 patent. The fire and water-resistant container does not use fire resistant ceramic fibers.

Foreign Patent Application No. JP 08270323 to Hineno discloses a fireproof safe. A box has an outer case that contains an inner case. The space between the two cases is filled with burnt ash of activated carbon, which is a very porous carbon material. The burnt activated carbon ash is no longer a fiber and therefore, it is not a fire resistant ceramic fiber. The type of material used for the outer case and the inner case is not indicated.

There remains a need in the art for a lightweight portable fire resistant containment system that saves valuable photographs and documents in an unaffected condition even when exposed to a fire lasting for up to 30 minutes.

SUMMARY OF THE INVENTION

The present invention discloses lightweight portable fire resistant containment system comprising: (i) a outer shell with a outer surface and an inner surface; (ii) an inner shell having an outer surface and an inner surface; (iii) said outer surface of inner shell fitting within the inner surface of the outer shell with an air gap there between; (iv) a lid covering the outer surface of the outer shell, forming a closed enclosure for containing valuable photographs and documents within the interior of the inner shell and inner shell; (v) said outer shell, inner shell and lid being made from ceramic fibers bonded with inorganic or carbon based bonds; (vi) said outer surface of outer shell having a stainless steel sheath preventing entry of hot gases from a fire flame into the ceramic fibers of said outer shell; (vii) said outer surface of said inner shell having an infrared reflective metallic covering reflecting infrared heat from the inner surface of the outer shell, prolonging protection offered by said lightweight portable fire resistant containment; (vii) said inter surface of inner shell being provided with an encased porous ceramic body filled with solidified phase change material; (viii) optionally a bottom hole provided in said encased porous ceramic body to discharge molten phase change material into the gap between said outer shell and said inner shell, leaving behind an insulating porous ceramic body that prevents further heat transmission to the interior of the containment. The outer shell may have a wall thickness in the range of 12 mm to 25 mm. The air gap may have a dimension in the range of 3 mm to 6 mm. The inner shell may have a wall thickness in the range of 8 mm to 20 mm.

The outer shell of the lightweight portable fire resistant containment system is entirely fabricated from ceramic fibers that may be woven, non-woven or needled. Fibers arranged in this manner have air gaps there between and are quite insulating. Since the ceramic fibers have a melting point greater than 2000° F., a typical maximum temperature attained in house fires, these fibers in the outer shell do not melt. The ceramic fibers may be mineral wool, glass fibers including S glass, E glass or common fiberglass. The fibers are locked in place by an inorganic binder such as sodium silicate, which upon interaction with ambient carbon dioxide results in colloidal silica that bonds the ceramic fibers. The inorganic bond may be charred carbon residue such as carbonized phenolic or epoxy resin. The carbonized residue forms when these resins are subjected to heat in an atmosphere that lacks excess oxygen. Thus the formed outer shape is lightweight, rigid and holds the shape of a storage container. The lid for the storage compartment is also prepared in a similar manner.

The inner shell is fabricated in a manner similar to the outer shell and also has insulation properties. The inner shell is offset from the outer shell leaving an air gap that provides insulation. The overall weight of the lightweight portable fire resistant containment system is due to the lightness of the lid, outer shell, inner shell and the air gap there between. As the outer shell is subjected to fire from a house flame, the outer surface of the outer shell reaches high temperature quickly due to its low mass. However, the heat from the outer surface of the outer shell is only conducted through the wall of the outer shell due to the insulation properties of the bonded ceramic fibers together with air gaps present there between. After some time of fire exposure, the outer surface of the inner shell begins to receive heat from radiation from the inner surface of the outer shell.

The inner shell outer surface has a metallic infrared reflective covering that effectively reflects the radiation emitted by the inner surface of the outer shell. Thus the radiation emitted from the hot inner surface of the outer shell only slowly imparts heat to the inner shell, heating its outer surface. Due to the insulation properties of the inner shell, it takes a long time for the interior surface of the inner shell to heat to high temperatures, sufficient to damage the photographs of documents contained within the lightweight portable fire resistant containment system. The overall heat content, which is controlled by the mass of the outer and inner shells collectively, is small due to the low density of bonded ceramic fibers.

The interior surface of the inner shell has an encased porous ceramic body such as inorganically bonded loose fibers infiltrated with a molten phase change material. The encased porous ceramic body has a bottom hole that is plugged during infiltration of the phase change material. The encased porous ceramic body is cooled to freeze the phase change material within the porous ceramic body. The encased porous ceramic body is placed within the interior surface of the inner shell and the contents of the lightweight portable fire resistant containment system only receives heat from the interior surface of the porous ceramic body that has frozen phase change material. The porous ceramic body with frozen phase change material can absorb heat coming through the interior surface of inner shell eventually melting the phase change material starting from the top maintaining the temperature of the porous ceramic body at the melting temperature of the phase change material until all of the phase change material is completely molten. Several compositions of phase change material including hydrated inorganic salts each having its unique melting point together with known latent heat of fusion, which is the heat that is effectively absorbed during phase change.

In a second embodiment, the encased porous ceramic has a bottom hole and is placed within the interior of the inner shell. The bottom hole communicates with the air gap between the outer and inner shell at the bottom, thereby discharging the molten phase change material when fully molten, leaving behind the encased porous ceramic material with a plurality of insulating air gaps, restricting heat delivery to the valuable documents within the containment. The heat received by the phase change material is lost as the molten phase change material is discharged through the bottom hole of the encased porous ceramic body reducing the heat delivered to the valuable photographs or documents contained within the lightweight portable fire resistant containment system. The lightweight portable fire resistant containment system can easily withstand fire exposure according to standard fire exposure test.

Briefly stated, the invention involves a storage box an outer shell that contains an inner shell closed by a tight fitting lid. The outer shell, inner shell and lid are all made from bonded ceramic fibers that provide low mass reducing heat retention, insulating due to porosity. Thus the outer surface of the outer shell heats first, conducting heat slowly through the thickness of the outer shell, heating the inner surface of the outer shell. The heat has to be emitted by infrared radiation through the air gap between the outer shell and the inner shell, heating the outer surface of the inner shell, the absorption of which is reduced by a metallic foil reflector. Any heat that is absorbed is conducted through the thickness of the inner shell to the interior of the inner shell, which contains the valuable photographs and documents. The inner surface additionally has an encased porous ceramic body infiltrated with solidified phase change material which absorbs heat during melting, accepting latent of heat of fusion, thus keeping the temperature of the encased porous ceramic body at the melting point of the phase change material. According to the second embodiment, the completely molten phase change material is discharged through a bottom hole in the encased porous ceramic body into the air gap between the outer shell and the inner shell, thus getting rid of the heat accumulated and leaving behind a porous insulating ceramic body with a plurality of air holes. This strategy allows the lightweight portable fire resistant containment system to protect the valuable photographs and documents for a time period of about 30 minutes, a typical house fire situation.

Significant advantages are realized by practice of the present invention. The key features of the lightweight portable fire resistant containment system include, in combination, the features set forth below:

1) a portable fire resistant containment box having an outer shell, inner shell spaced from the outer shell by an air gap and a lid box creating an enclosed space within the inner shell for valuable photographs or documents that need to be protected in the event of fire exposure;
2) said outer and inner shells and lid entirely fabricated from fire resistant ceramic fibers including mineral wool fibers, glass fibers and the like bonded to each other by an inorganic bond or charrable organic bond, forming a porous insulating yet mechanically strong structure;
3) said inorganic bond created by sodium silicate exposed to carbon dioxide to create a colloidal silica inorganic bond, hydrated to create a magnesium sulfate hydrate inorganic bond or a metal organic compound heated to create a metal oxide inorganic bond;
4) said organic bond heating a charrable high carbon yield resin such as phenolic resin or epoxy resin cross linked with epoxide;
5) said outer shell covered with a stainless steel sheath to prevent entry of hot gases from the flame into the porosities of a bonded ceramic fiber outer shell;
6) the outer surface of said inner shell covered with an infrared reflecting metallic sheet to reduce the amount of heat received from the inner surface of said outer shell thereby reducing the heating rate of the inner shell;
7) said interior surface of said inner shell having an encapsulated ceramic porous body filled with molten and subsequently solidified phase change material, melting at a temperature lower than degradation temperature of the valuable photographs or documents contained within said lightweight portable fire resistant containment system; and
8) optionally, said encapsulated porous ceramic body having an open hole at the bottom discharging fully molten phase change material into the air gap between said outer and inner shell, presenting a porous insulating ceramic body between the inner surface of inner shell and valuable photographs or documents;

whereby the lightweight portable fire resistant containment system sustains exposure to fire for up to 30 minutes typically having flame temperatures below 2000° F., while the contents there within are protected by reducing thermal exposure to a temperature significantly less than the 400° F. ignition temperature of paper.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
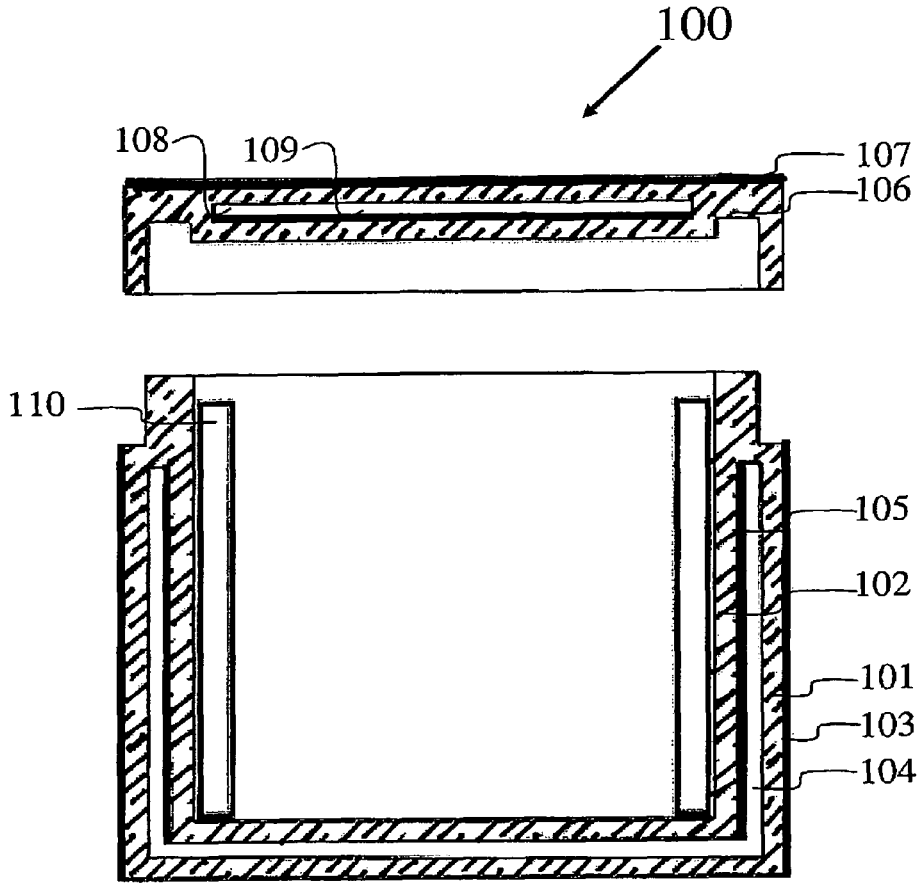
FIG. 1 schematically illustrates the elements of the first embodiment of the lightweight portable fire resistant containment system.

Storage of important personal papers, memorabilia and valuable items in the home and/or office is necessary. Damage or total loss of personal papers and irreplaceable items can occur as the result of fires and floods, which destroy the home or office property. Frequently these important papers are difficult and administratively taxing to replace. Memorabilia, photographs, memory keepsakes and other items are simply irreplaceable and are lost forever. Commercially available safe boxes for the home or office are constructed of heavy materials, making these safes difficult to move and carry. Where lighter weight safes are constructed, these safes fail to provide the ability to withstand high temperatures.

This invention relates to a lightweight portable fire resistant containment system comprising: (i) an outer shell of a storage compartment that is composed of refractory ceramic fiber bonded together with a refractory binder; (ii) said outer shell having a ceramic fiber bonded inner shell fitting within the interior of the outer shell; (iii) an air gap formed between the outer shell and the inner shell; (iv) a lid of bonded ceramic fibers closing the outer shell to define a contained area; (v) the outer shell having a stainless steel sheet covering preventing ingress of hot gases from a fire or flame into the bonded ceramic fibers; (vi) said inner shell outer surface having a metallic covering reflecting infrared heat emitted by the inner surface of the outer shell; (vii) said inner shell having an enclosed porous body containing solidified phase change material (PCM) as an interior lining, absorbing heat by latent heat of fusion during melting and preventing temperature rise of enclosed porous body beyond the melting point until all PCM contained is completely molten; and (viii) optionally, said enclosed porous body having an open bottom hole for discharging molten PCM into the air gap between the outer shell and inner shell, thereby creating a porous insulating body providing further insulation preventing heating of the storage compartment valuable content.

The lightweight portable fire resistant containment system functions as a fireproof compartment for storing documents and other valuable items. The lightweight portable fire resistant containment system has two embodiments that are shown in the figures and discussed in the detailed description below.

In its preferred embodiment, the lightweight portable fire resistant containment system of the present invention comprises a flame resistant safe box fabricated from ceramic fibers that are bonded together by an inorganic flame resistant binder yet leaving adequate porosity to create light weight, low thermal mass insulating boards that form the sides and removable top closure of the lightweight portable fire resistant containment system. Even though the external surface of the box reaches flame temperature when exposed to a burning building, for example, the ceramic fibers and the inorganic binder used resist melting at the flame temperature and the insulating properties of the boards along with its low thermal mass prevent the transfer of heat to the interior of the fire resistant safe box, thereby preventing damage to documents and photographs stored there within. The contents cannot reach temperatures in the 400° F. range, the temperature at which paper catches fire.

FIG. 1 shows at 100 a cross section of the lightweight portable fire resistant containment system for storing documents and other valuable items according to the first embodiment. In this first embodiment, the lightweight portable fire resistant containment comprises an outer shell 101 composed of bonded refractory ceramic fiber. The bonding agent for the fire proof refractory fibers may be sodium silicate, which hardens by reaction with ambient carbon dioxide to form a colloidal silica bond, or a carbonaceous resin that chars readily to slow burning amorphous carbon such as phenolic resin or an epoxy resin cross linked with polyimide. Other bonding agents include magnesium sulfate hydrate, and other metal-organic compounds that crack when subjected to heat. The bond created by the bonding agent inherently produces a highly porous bond structure due to the requirement of carbon dioxide permeability or charring reaction, and thus results in a highly effective lightweight insulator that has a reasonable mechanical rigidity. The outer shell 101 has an inner shell 102 composed of bonded ceramic fibers produced in a manner similar to the outer shell. The outer surface of the outer shell has a metallic stainless steel wrap 103 preventing ingress of hot gas from fire or flame directly into the space between the bonded fibers of the outer shell. An air gap 104 is present between the inner surface of the outer shell and the outer surface of inner shell. This air gap acts an insulator reducing the heating rate of the interior of the containment. The outer surface of the inner shell has a metallic reflector 105 to reflect infrared radiation emitted by the interior surface of the outer shell. A lid 106 also made from bonded ceramic fibers is provided to enclose the upper surface of the outer shell forming the containment. As shown in the figure, the outer shell also has an air gap 107, a stainless steel metallic protection 108 preventing entry of hot gases and an infrared reflecting metallic foil 109. The inert shell 102 has an encased porous ceramic body 110, which has infiltrated molten phase change material that is solidified first prior to insertion within the inner shell. When sufficient heat is received at the inner surface of the inner shell, it begins to heat the encased porous ceramic body raising the phase change material temperature to its melting point. This phase change material can absorb heat until all the phase change material is melted and its heat absorption capacity is exhausted. During this period, the interior temperature of the lightweight portable fire resistant containment system is maintained at or below the melting point temperature of the phase change material. This phase change material melting temperature for the lightweight portable fire resistant containment system is selectable and is generally in the range of 150 to 300° F. The LT phase change material keeps the temperature of the contents in the containment at the lowest value.

Figure 2:
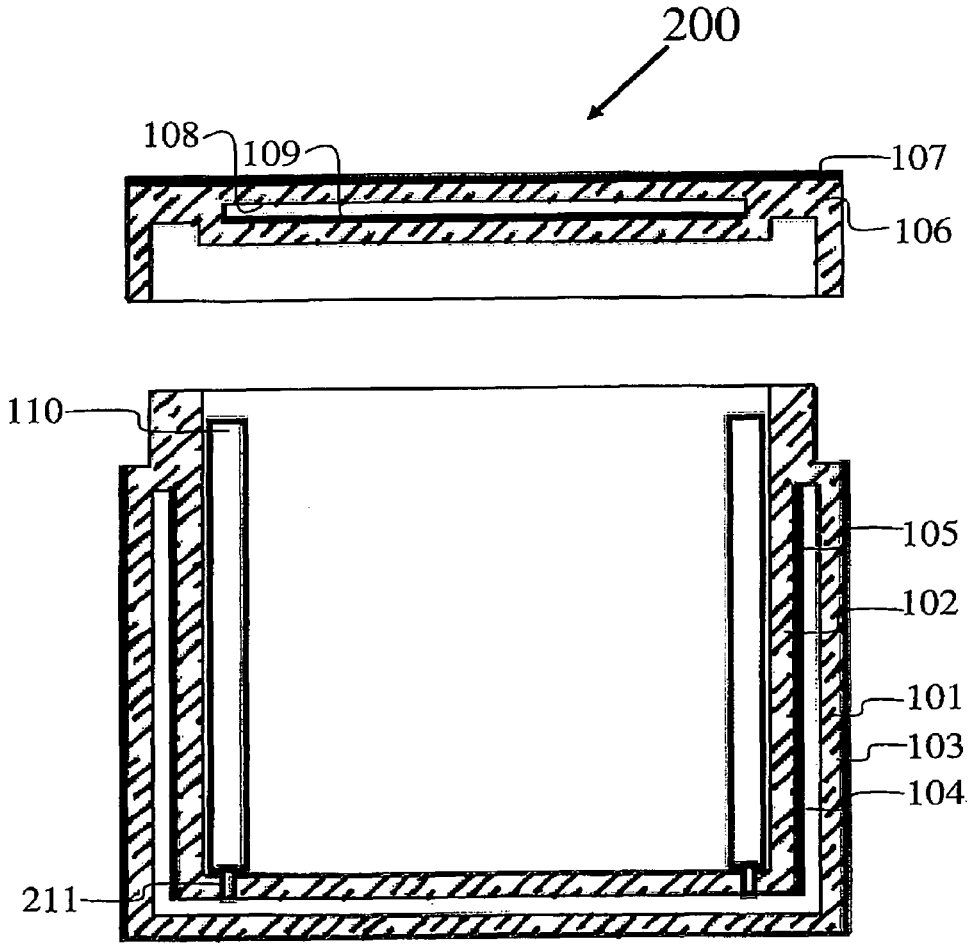
FIG. 2 schematically illustrates the elements of the second embodiment of the lightweight portable fire resistant containment system.

FIG. 2 shows at 200 a cross section of the lightweight portable fire resistant containment system for storing documents and other valuable items according to the second embodiment. Identical numerical indicia similar to FIG. 1 are used for convenience. The encased porous ceramic body 110 with infiltrated phase change material has a bottom hole 211, which communicates with the air gap between the outer shell and inner shell at the bottom portion of the lightweight portable fire resistant containment system. Since the melting of the phase change material occurs from the top, the bottom hole remains plugged until all the phase change material melts. At this point, the molten phase change material along with all the heat absorbed is discharged into the air gap region at the bottom. The encased porous ceramic body now has a plurality of air holes, the places originally occupied by the phase material, providing further insulation.

Figure 3:
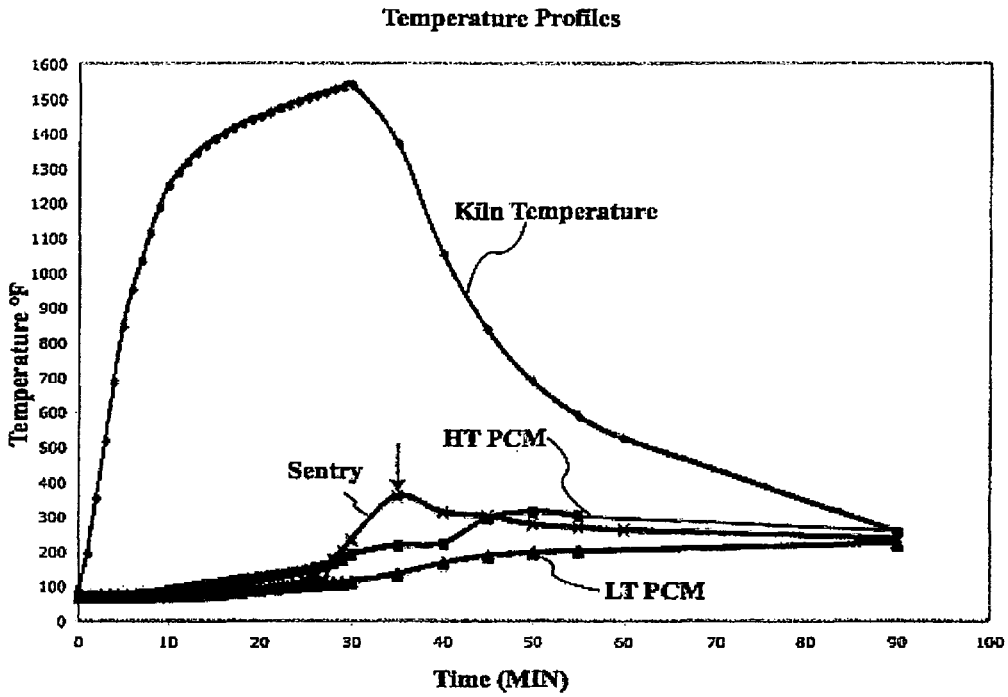
FIG. 3 shows the temperature curves of the lightweight portable fire resistant containment system that is placed within a kiln.

FIG. 3 illustrates experimental data measured on a lightweight portable fire resistant containment system using two variants of phase change material. The test was conducted according to Underwriter Lab specifications. The lightweight portable fire resistant containment system was placed in a kiln and brought to a temperature of 1541° F. in a period of 30 minutes, simulating a fire exposure situation. The temperature inside the lightweight portable fire resistant containment system was measured by thermocouple and recorded to be about 108° F. The test was repeated for two compositions of phase change materials, one with a melting point of 200° F. and the other with a melting point of about 315° F. Clearly, the temperature inside the lightweight portable fire resistant containment system is maintained at this phase change material melting temperature and the objects placed within the containment pass the fire proof test. A comparable example of a commercial fireproof box made by Sentry is shown. The Sentry fireproof box fails UL specifications at 35 minutes with the inside temperature reaching 359° F. The failure time period is marked by the arrow. The low temperature phase change material within the lightweight portable fire resistant containment system protects contents, demonstrating superior performance, and can withstand fire exposure for temperatures greater than 30 minutes.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A lightweight portable fire resistant containment system comprising;

a) an outer shell having an outer surface and an inner surface;

b) an inner shell having an outer surface and interior surface fitting inside the inner surface of said outer shell creating an air gap between said outer shell and said inner shell, wherein said air gap is unobstructedly and continuously formed by a space between the entire outer surface of said inner shell and said inner surface of said outer shell;

c) a lid closing the outer shell, and defining an enclosed space for protecting valuable photographs and documents from fire damage;

d) said outer and inner shells and lid entirely fabricated from fire resistant ceramic fibers including mineral wool fibers, glass fibers and the like bonded to each other by an inorganic bond or charrable organic bond forming a porous insulating yet mechanically strong structure;

e) said outer shell covered with a stainless steel sheath to prevent entry of hot gases from the flame into the porosities of the bonded ceramic fiber outer shell;

f) the outer surface of said inner shell covered with an infrared reflecting metallic sheet to reduce the amount of heat received from the inner surface of said outer shell thereby reducing the heating rate of the inner shell; and g) said interior surface of said inner shell having an encapsulated ceramic porous body filled with molten and subsequently solidified phase change material, melting at a temperature lower than the degradation temperature of the valuable photographs or documents contained within said lightweight portable fire resistant containment system;

whereby the lightweight portable fire resistant containment system sustains exposure to fire for up to 30 minutes typically having flame temperatures below 2000° F., while the contents there within are protected by reducing thermal exposure to a temperature significantly less than the 400° F. ignition temperature of paper.

2. A lightweight portable fire resistant containment system as recited by claim 1, wherein said inorganic bond created by sodium silicate exposed to carbon dioxide to create a colloidal silica inorganic bond.

3. A lightweight portable fire resistant containment system as recited by claim 1, wherein said inorganic bond is formed by hydration to create a magnesium sulfate hydrate inorganic bond.

4. A lightweight portable fire resistant containment system as recited by claim 1, wherein said charrable organic bond is formed by heating a charrable high carbon yield resin such as phenolic resin or epoxy resin cross linked with epoxide.

5. A lightweight portable fire resistant containment system as recited by claim 1, wherein said encapsulated porous ceramic body having an open hole at the bottom discharging fully molten phase change.

6. A lightweight portable fire resistant containment system as recited by claim 5, wherein said encapsulated porous ceramic body bottom hole has connection to the air gap between said outer shell and inner shell.

7. A lightweight portable fire resistant containment system as recited by claim 1, wherein said encapsulated porous ceramic body contains infiltrated and solidified phase change material with a temperature in the range of 175° F. to 300° F.

8. A lightweight portable fire resistant containment system as recited by claim 1, wherein said outer shell has a wall thickness in the range of 12 mm to 25 mm.

9. A lightweight portable fire resistant containment system as recited by claim 1, wherein said inner shell has a wall thickness in the range of 8 mm to 20 mm.

10. A lightweight portable fire resistant containment system as recited by claim 1, wherein said air gap between outer shell and inner shell has a dimension in the range of 3 mm to 6 mm.

* * * * *